US010414531B2

(12) United States Patent
Ensor et al.

(10) Patent No.: US 10,414,531 B2
(45) Date of Patent: Sep. 17, 2019

(54) BAG-FILLING MACHINE

(71) Applicants: Mark E. Ensor, San Jose, CA (US); Thomas J Burns, Campbell, CA (US)

(72) Inventors: Mark E. Ensor, San Jose, CA (US); Thomas J Burns, Campbell, CA (US)

(73) Assignee: Golden Gate Mechanical, Inc., Santa Clara, CA (US)

( * ) Notice: Subject to any disclaimer, the term of this patent is extended or adjusted under 35 U.S.C. 154(b) by 1180 days.

(21) Appl. No.: 14/684,048

(22) Filed: Apr. 10, 2015

(65) Prior Publication Data

US 2015/0298841 A1 Oct. 22, 2015

Related U.S. Application Data

(60) Provisional application No. 61/980,522, filed on Apr. 16, 2014.

(51) Int. Cl.

| | |
|---|---|
| ***B65B 43/46*** | (2006.01) |
| ***B65B 1/06*** | (2006.01) |
| ***B65B 39/00*** | (2006.01) |
| ***B65B 43/30*** | (2006.01) |
| ***B65B 43/52*** | (2006.01) |
| ***B65B 51/07*** | (2006.01) |
| ***B65G 57/03*** | (2006.01) |
| ***B65B 43/34*** | (2006.01) |
| ***B65B 57/06*** | (2006.01) |
| ***B65B 57/14*** | (2006.01) |
| ***B65B 61/28*** | (2006.01) |

(Continued)

(52) U.S. Cl.

CPC ..... *B65B 43/465* (2013.01); *B65B 1/06* (2013.01); *B65B 1/12* (2013.01); *B65B 39/001* (2013.01); *B65B 39/007* (2013.01); *B65B 43/34* (2013.01); *B65B 43/52* (2013.01); *B65B 51/07* (2013.01); *B65B 57/06* (2013.01); *B65B 57/145* (2013.01); *B65B 61/28* (2013.01); *E02B 3/127* (2013.01)

(58) Field of Classification Search

None

See application file for complete search history.

(56) References Cited

U.S. PATENT DOCUMENTS 2,507,905 A * 5/1950 Hughes ..... B65B 43/34 112/11
2,651,443 A * 9/1953 Carter ..... B65B 25/04 53/240

(Continued)

FOREIGN PATENT DOCUMENTS

| | | |
|---|---|---|
| CN | 2936926 Y | 8/2007 |
| CN | 202030010 U | 11/2011 |
| CN | 203528834 U | 4/2014 |

*Primary Examiner* — Hemant Desai
*Assistant Examiner* — Tanzim Imam
(74) *Attorney, Agent, or Firm* — Douglas L. Weller

(57) ABSTRACT

To fill bags, a hopper is used to stored fill material. Bag holders are mounted on a transport mechanism. At one or more operator stations, an operator attaches a bag to one of the bag holders. At one or more fill stations, fill material from the hopper is used to fill a bag attached to a bag holder. A conveyer mechanism conveys the bag, after it has been filled, away from the transport mechanism. The transport mechanism transports the bag holder with the attached bag from an operator station to a fill station. The transport mechanism also transports the bag holder from a fill station to an operator station.

20 Claims, 21 Drawing Sheets

(51) Int. Cl.
*B65B 1/12* (2006.01)
*E02B 3/12* (2006.01)

(56) References Cited

U.S. PATENT DOCUMENTS 4,300,602 A * 11/1981 Vadas ..... B65B 57/06
141/103
6,050,061 A * 4/2000 Todd ..... B65B 43/465
53/201
6,276,117 B1 * 8/2001 Wiles ..... B65B 43/465
53/384.1
7,438,201 B2 * 10/2008 Kim ..... B65B 5/103
221/200
7,644,558 B1 * 1/2010 Fallas ..... B25J 9/0093
53/251

* cited by examiner

BAG-FILLING MACHINE

BACKGROUND

Bags filled with sand, dirt, gravel or other fill material are often used for applications such as flood control, military fortifications and so on. Mobile bag machines can be transported to a jobsite to increase efficiency in filling bags with sand, dirt, gravel, or other fill material suitable for a desired application.

DESCRIPTION OF THE EMBODIMENT

Figure 1:
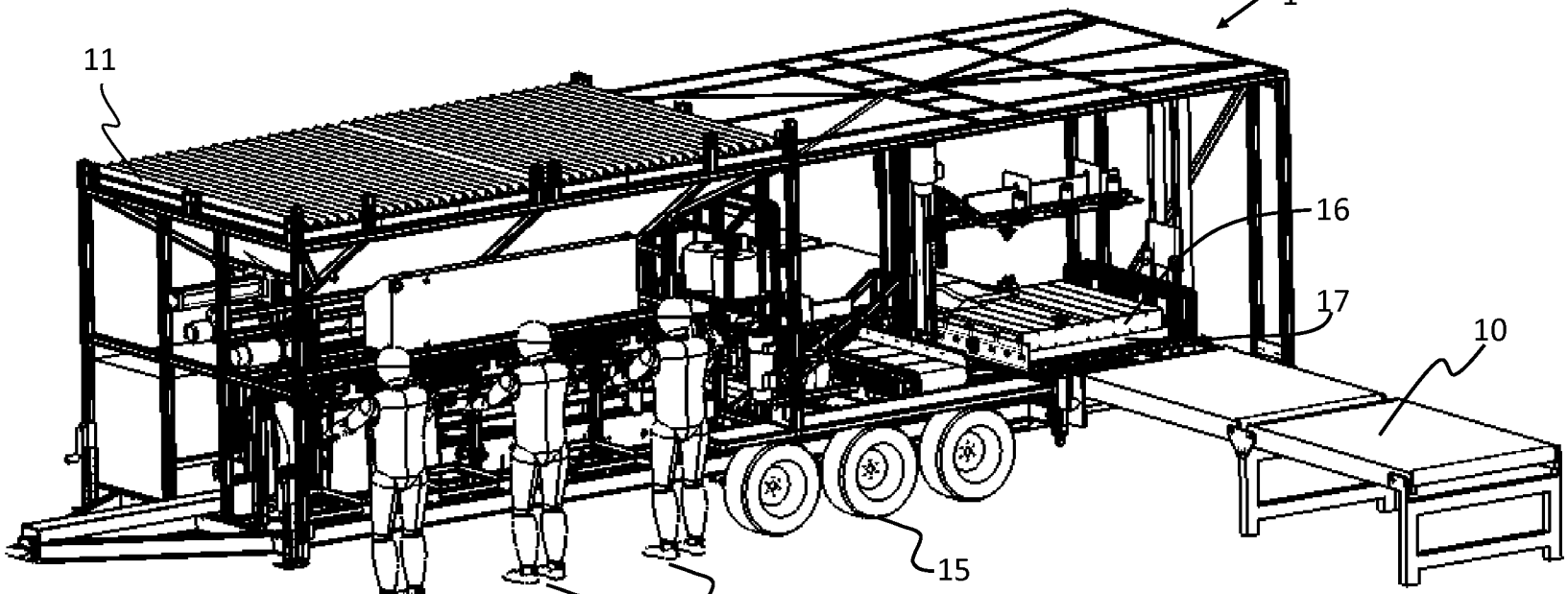
FIG. 1 shows a bag-filling machine in accordance with an implementation.

As is described further below, a bag-filling machine is used to fill bags. Fill material is stored in a hopper. Bag holders are mounted on a transport mechanism. At one or more operator stations, an operator attaches a bag to one of the bag holders. At one or more fill stations, fill material from the hopper is used to fill a bag attached to a bag holder. A conveyer mechanism conveys the bag, after it has been filled, away from the transport mechanism. The transport mechanism transports the bag holder with the attached bag from an operator station to a fill station. The transport mechanism also transports the bag holder from a fill station to an operator station.

For example, each bag holder includes strong clips that are disengaged when the operator attaches the bag to the bag holder, that are engaged when fill material from the hopper is used to fill the bag attached to the bag holder, and that are disengaged to allow the conveyer mechanism to convey the bag, after it has been filled, away from the transport mechanism. For example, each bag holder also includes additional clips that the operator uses to hold the bag to the bag holder before the strong clips are engaged.

For example, the conveyer mechanism includes a conveyer on which filled bags rest, pinch rollers that open the strong clips, and pinch rollers that hold the filled bags shut.

For example, the transport mechanism includes a roller chain to which the plurality of bag holders are attached. For example, each bag holder includes springs that hold the bag holder flat when the bag holder travels from the at least one operator station to the at least one fill station. At each fill station, an actuator opens the bag holder so that the bag attached to the bag holder is opened in preparation for being filled with the fill material.

In one implementation, there are three fill stations and three operator stations. There is at least one station between each of the three operator stations, so that each operator is not at an operator station immediately next to another operator station. In this configuration, for example, the transport mechanism moves each bag holder forward three stations and then pauses to allow operators at the three operator stations to each attach a bag to a bag holder, and to allow bags at the three fill stations to be filled with fill material.

For example, each fill station includes a dump chute and an actuator that opens the dump chute to allow fill material to flow from the dump chute to a bag held by a bag holder at the fill station. For example, a sensor within the dump chute detects whether the dump chute has a full load of material ready to flow into the bag held by the bag holder at the fill station. If there is not a full load of material ready to flow into the bag held by the bag holder at the fill station, the actuator is not opened. For example, another sensor detects whether there exists a bag held by the bag holder at the fill station. If there is no bag held by the bag holder at the fill station, the actuator is not opened.

For example, a sewing system sews the filled bags shut. The conveyer mechanism conveys the filled bag from the transport mechanism to the sewing system.

In one implementation, a palletizer system loads the filled bags onto a pallet. For example, the palletizer system includes a palletizer arm that transports the filled bags from the transport mechanism to the pallet, and includes a palletizer actuator conveyer that moves the pallet to facilitate stacking of filled bags in a desired configuration.

In one implementation, the hopper includes an auger that moves fill material towards the at least one fill station. For example, stirrer rods located along inner sides of the hopper are used to aid with movement of fill material in the hopper towards the at least one fill station.

FIG. 1 shows a bag-filling machine 1. Operators put bags 18 on clips in preparation for bags 18 being filled with fill material. For example, in FIG. 1 an operator 12, an operator 13 and an operator 14 are shown at bag attachment stations. After bags 18 are filled and sewn shut, they are loaded on a pallet 16, located on a palletizer actuator conveyer 17. A loading area 10 receives a filled pallet for shipment or use. Fill material is loaded into a hopper 11 to be available to be placed in bags 18. For example, bag-filling machine 1 is mounted on a trailer 15.

Figure 2:
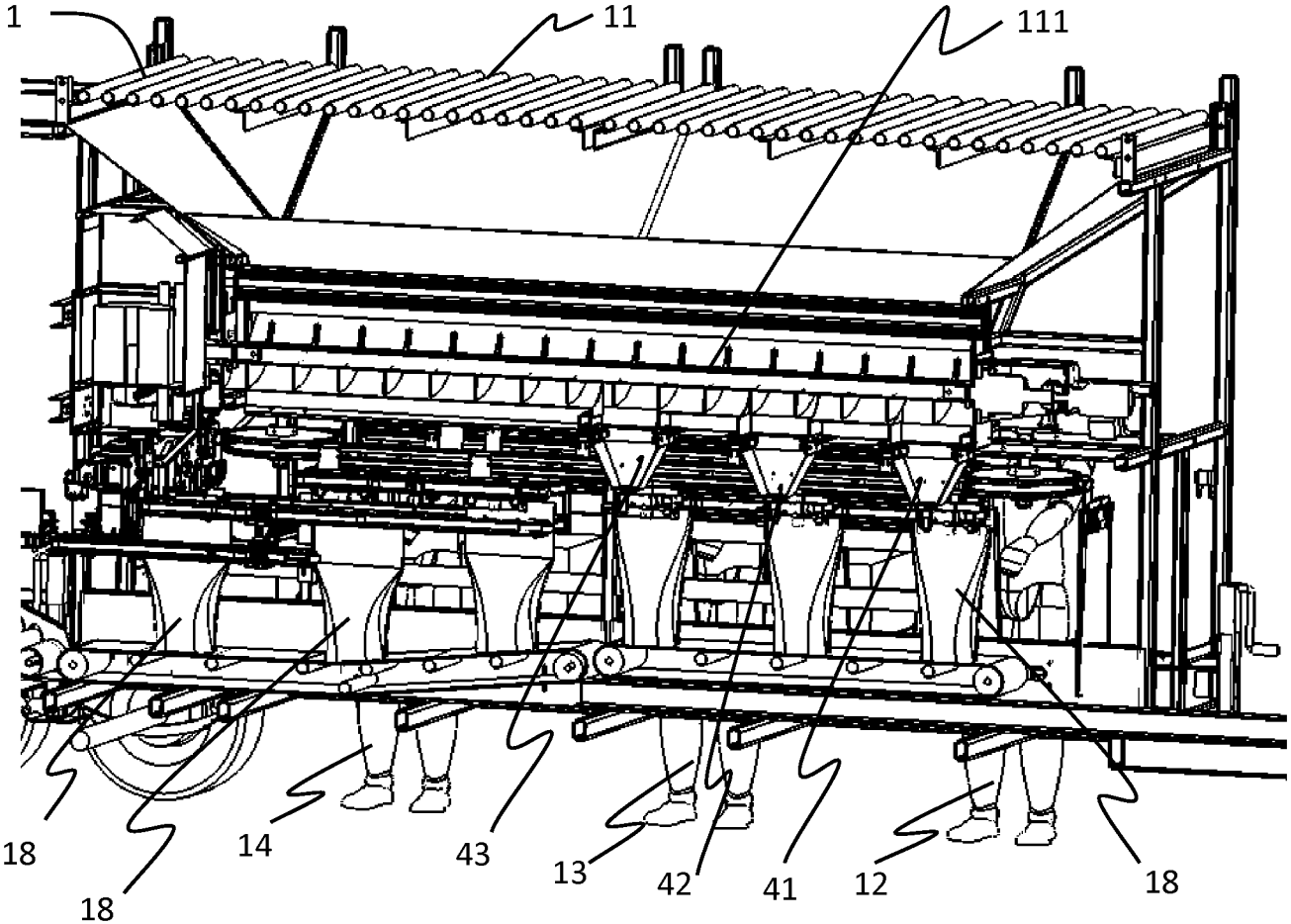
FIG. 2 shows another view of the bag-filling machine shown in FIG. 1 in accordance with an implementation.

FIG. 2 shows another view of the bag-filling machine 1. Bags 18 are loaded by a chute dump 41, a chute dump 42 or a chute dump 43. The fill material is directed from hopper 11 to chute dump 41, chute dump 42 and chute dump 43 by rotation of an auger 111. The rotation speed of auger 111 can be adjusted to control the rate at which the fill material is provided to chute dump 41, chute dump 42 and chute dump 43. Rotation of auger 111 can be varied to break up jammed fill material by reversing the flow in a cyclic manner.

Figure 3:
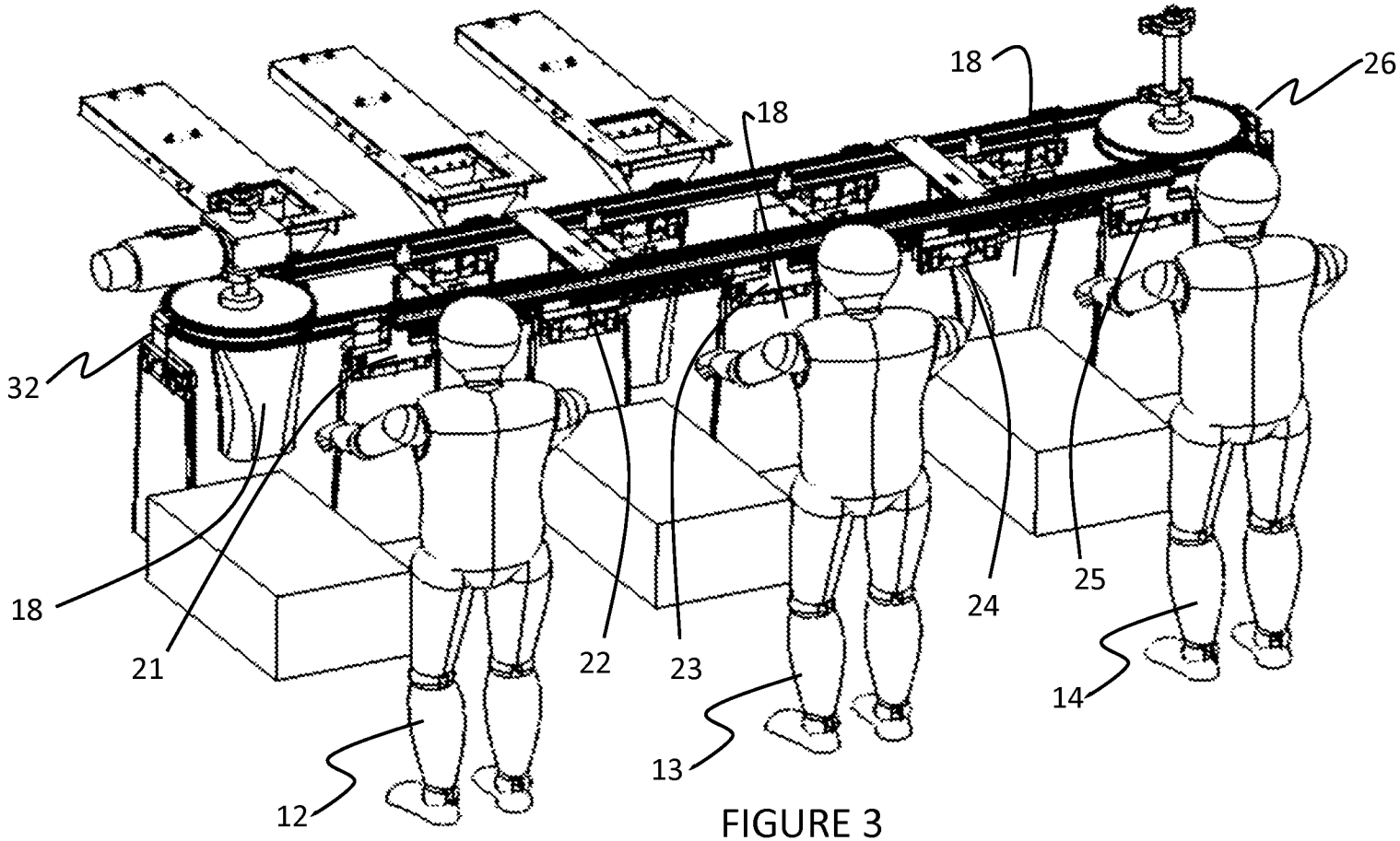
FIG. 3, FIG. 4 and FIG. 5 illustrate stations of a bag-filling machine in accordance with an implementation.
Figure 4:
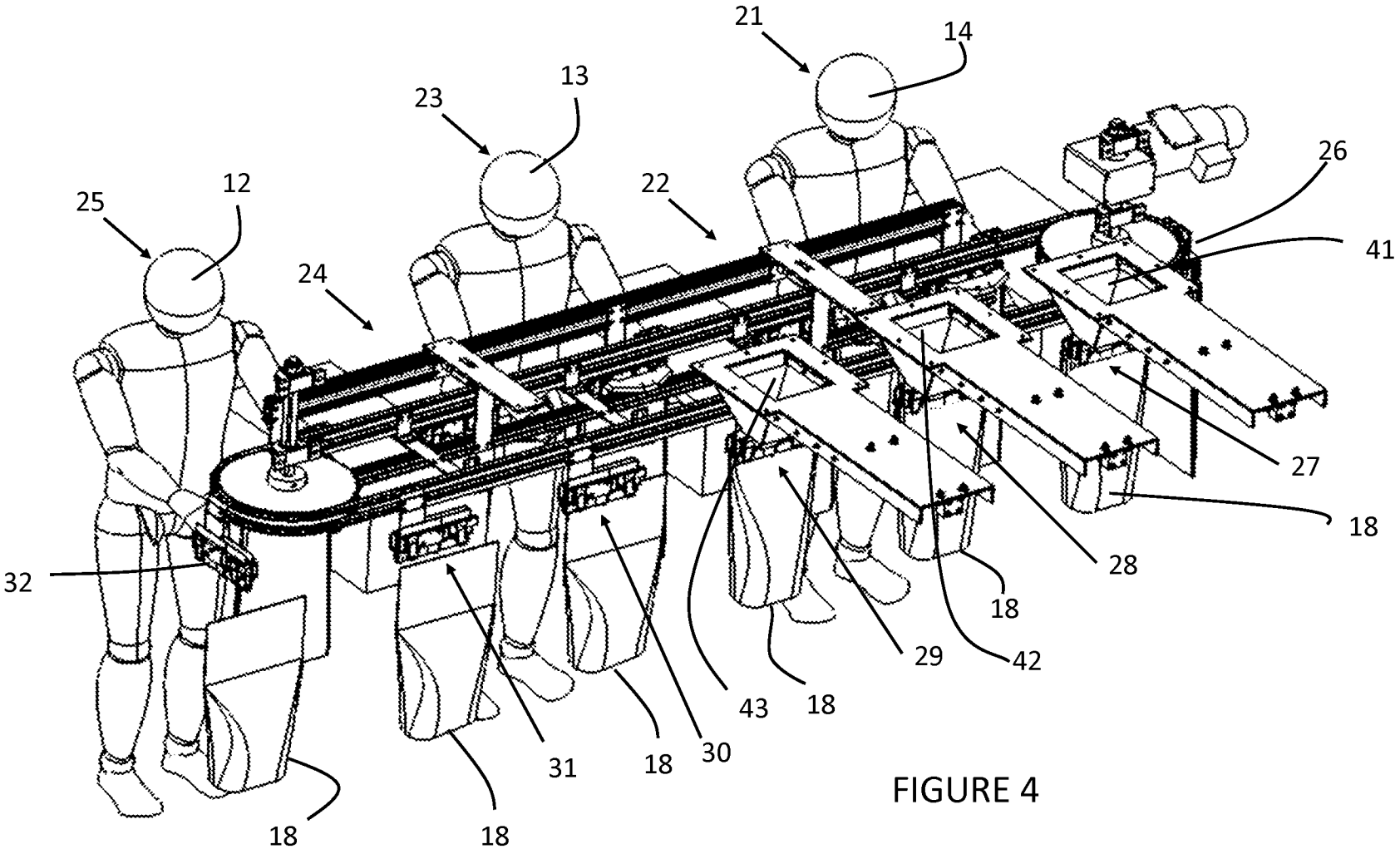
Figure 5:
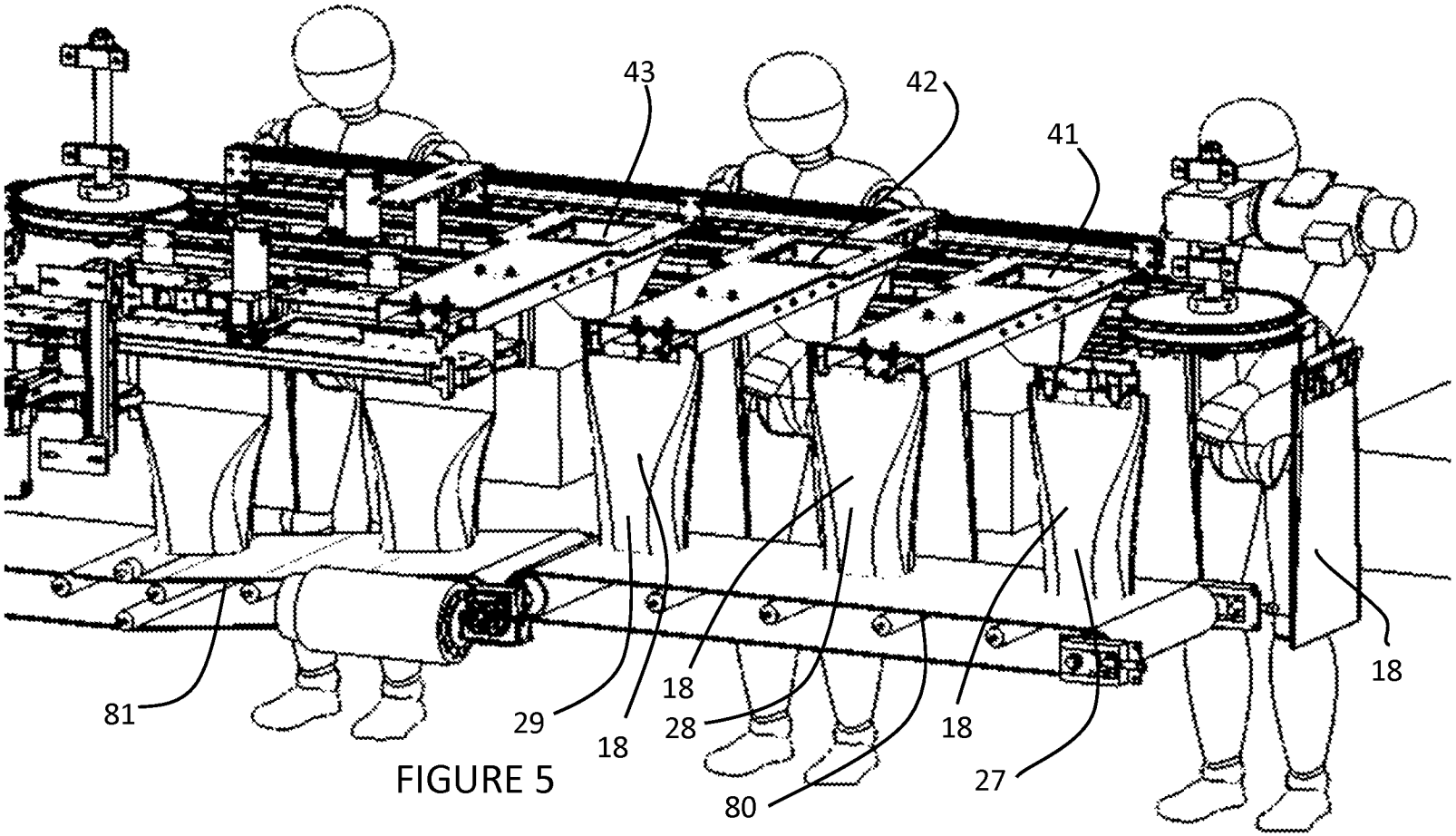

FIG. 3, FIG. 4 and FIG. 5 illustrate the twelve stations of bag-filling machine 1. At a station 21, operator 12 attaches bag 18 to a bag holder 19. At a station 22, bag 18 is already attached to bag holder 19 ready to be filled with sand. At a station 23, operator 13 attaches bag 18 to bag holder 19. At a station 24, bag holder 19 is ready to receive a bag 18, which will be added at station 21 by operator 12. At a station 25, operator 14 attaches bag 18 to bag holder 19. At a station 26, bag holder 19 is ready to receive a bag 18, which will be added at station 23 by operator 13. At a station 32, bag 18 is already attached to bag holder 19 ready to be filled with sand. At a station 31, bag 18 has been opened and is filled with material poured through chute dump 41. At a station 30, bag 18 has been opened and is filled with material poured through chute dump 42. At a station 29, bag 18 has been opened and is filled with material poured through chute dump 43. As bags 18 travel through a station 28 and a station 27, the filled bags 18 are released from bag holders 19 so that by station 26, bag holder is empty and ready for attachment of another bag by an operator.

When transportation of bag holders 19 pauses, the pause is long enough so that operators 12, 13 and 14 have enough time to place bags 18 onto bag holders 19 at stations 21, 23 and 25. Also, it gives time for chute dumps 41, 42 and 43 to fill bags 18 currently at stations 31, 30 and 29. The bag holders 19 are then advanced three stations before another pause in transportation of bag holders 19. This arrangement of stations allows for sufficient spacing between operators 12, 13 and 14 so that their work environment can be optimized for both efficiency and comfort.

As shown in FIG. 5, during filling at stations 31, 30 and 29, bags 18 are supported by a conveyer 80. An optical sensor at each of stations 31, 30 and 29 confirm a bag 18 is attached to a bag holder 19 before supplying material down a corresponding chute dump. If there is no bag 18 detected, the chute dump at the corresponding station remains closed so that no material passes through that chute dump. In this way, if one of the operator stations is not manned, bag-filling machine 1 can keep operating. Also, whenever one operator has trouble with a bag, or during start-up, or when for whatever reason not every bag holder has a bag, bag-filling machine 1 can continue operation. When starting up, bag-filling machine can rely on the sensors to prevent dump chutes from operating when no bag is present. Also, or in addition, a special start up sequence can be used where bags are only advanced one station to allow operators to put six bags 18 in a row on bag holders 19 before bags 18 are rotated to stations 31, 30 and 29.

After filling, as bag holders 19 are transported three stations ahead, a conveyer 81 drops filled bags 8 down and off bag holders 19 so that bags 18 can proceed to an area where bags 18 are sewn shut.

Figure 6:
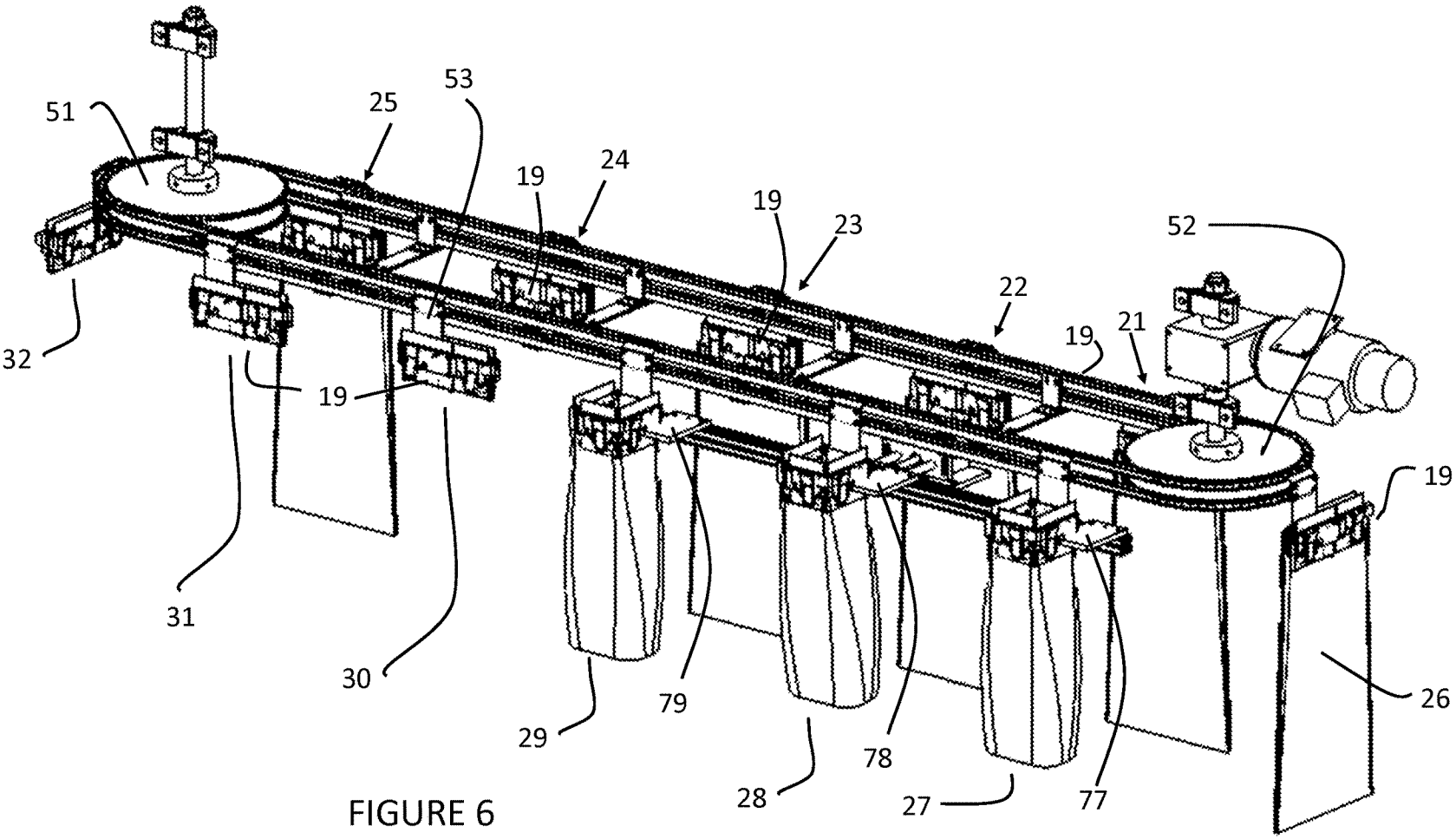
FIG. 6 illustrates bag transportation in a bag-filling machine in accordance with an implementation.

While FIG. 5 shows twelve stations with three stations having dump chutes and three stations having operating to load bags onto bag holders, other configurations can also be used. In general bagging system 1 will include one or more dump chutes and one or more operator stations. FIG. 6 shows bag holders 19 being mounted on a roller chain 53 and a roller chain 54. Roller chain 53 and roller chain 54 are driven by a sprocket wheel 51 and a sprocket wheel 52. Locations of roller chain 53 and roller chain 54 that are not in contact with sprocket wheel 51 and sprocket wheel 52 are mostly contained within UHNW carrier rails 63 and 64 to maintain stiffness and straightness of bag holders 19. Instead of a roller chain, another transport mechanism, such as based on a belt, cable or rail system, can be used.

Figure 7:
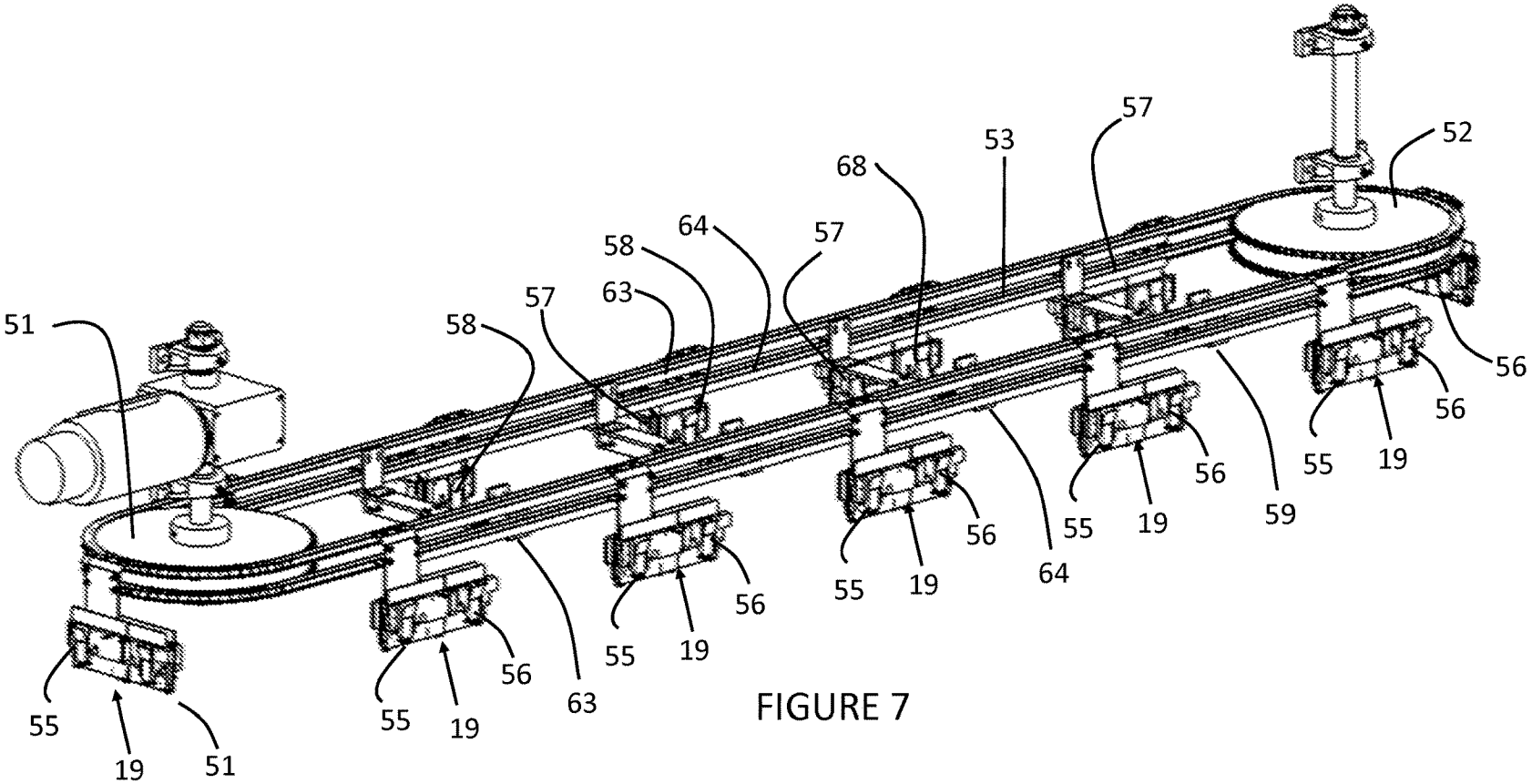
FIG. 7, FIG. 8 and FIG. 9 show implementation details of bag holders for a bag-filling machine in accordance with an implementation.
Figure 8:
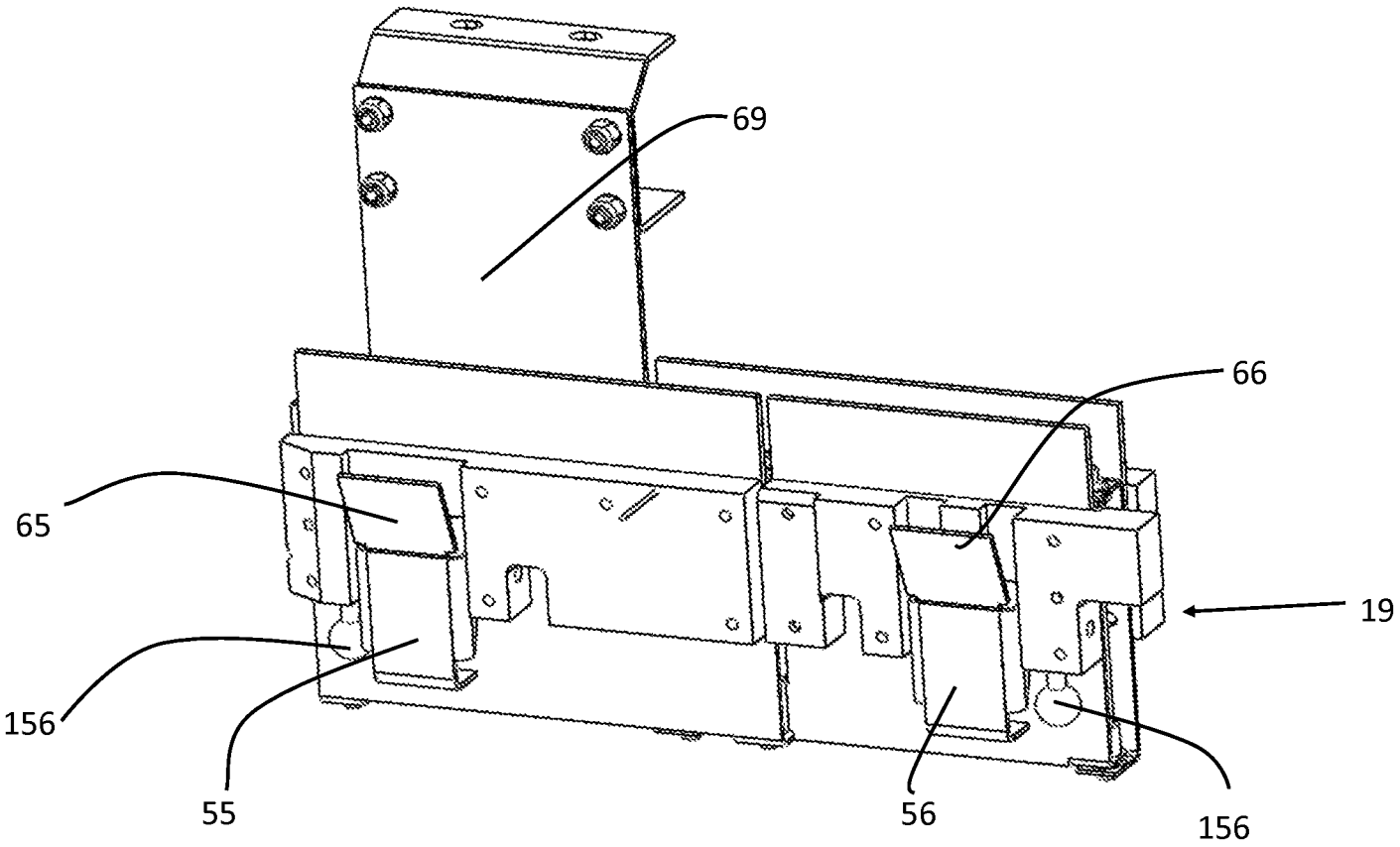
Figure 9:
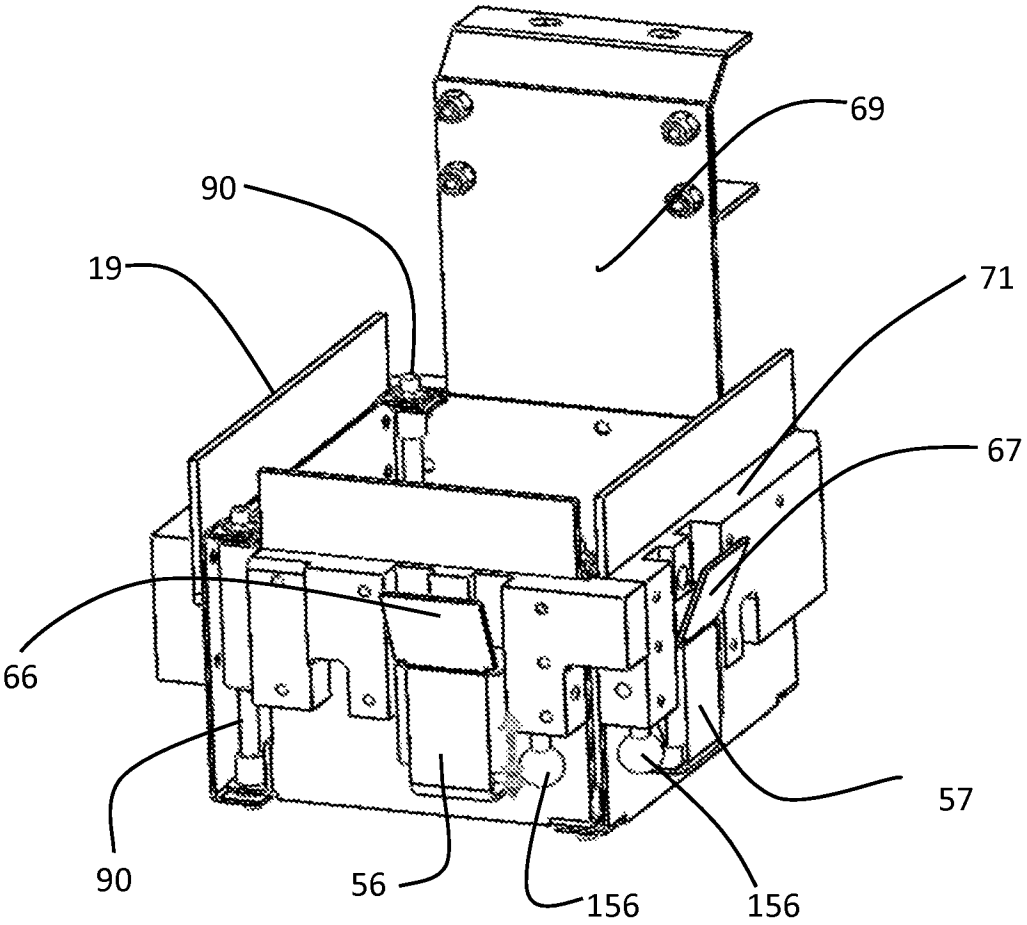

FIG. 7, FIG. 8 and FIG. 9 show implementation details of bag holders 19. When bag holders 19 are in a flattened position, a bag clip 55 and a bag clip 56 are on a front side of each bag holder 19, and a bag clip 55 and a bag clip 56 are on a back side of each bag holder 19, and a bag clip 57 and a bag clip 58 are on a back side of each bag holder 19. At station 31, at station 30 and at station 29, where bag holder 19 are in an opened position allowing bags 18 to be filled, facing each bag holder 19, bag clip 56 is at a front of bag holder 19, bag clip 55 is at a left side of bag holder 19, bag clip 58 is at a back of bag holder 19 and bag clip 37 is at a right side of bag holder 19.

Figure 19:
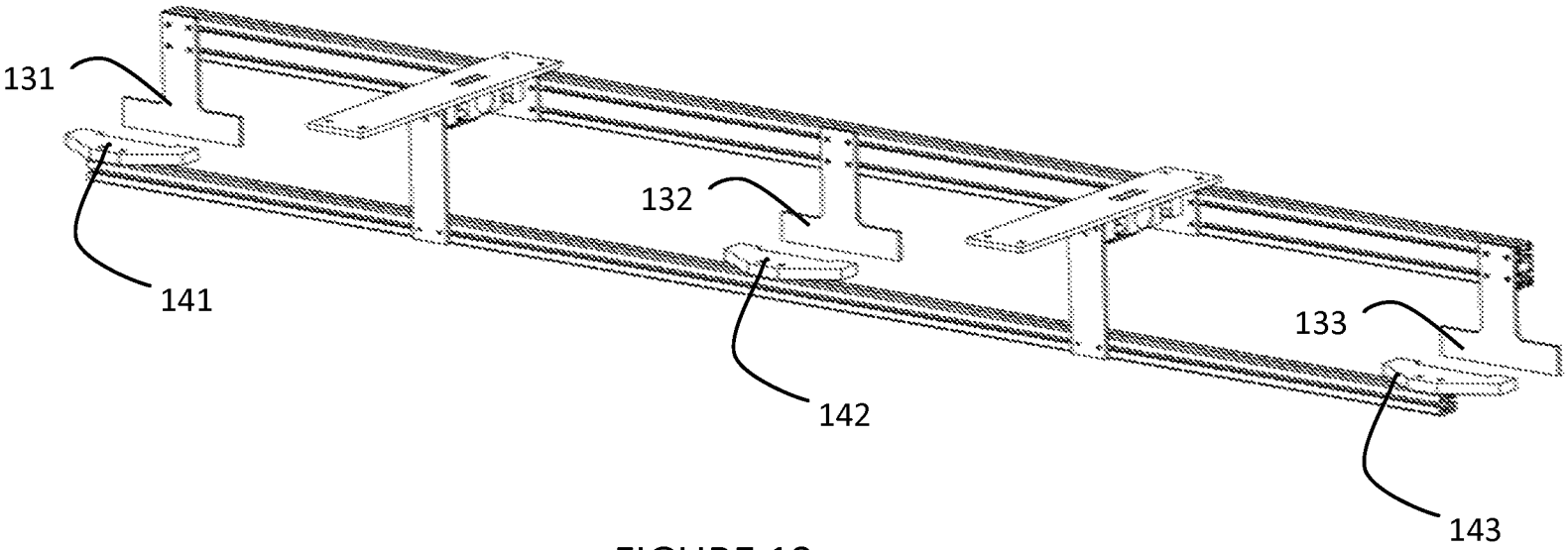
FIG. 19 and FIG. 20 show an actuator structure for a bag-filling machine in accordance with an implementation.
Figure 20:
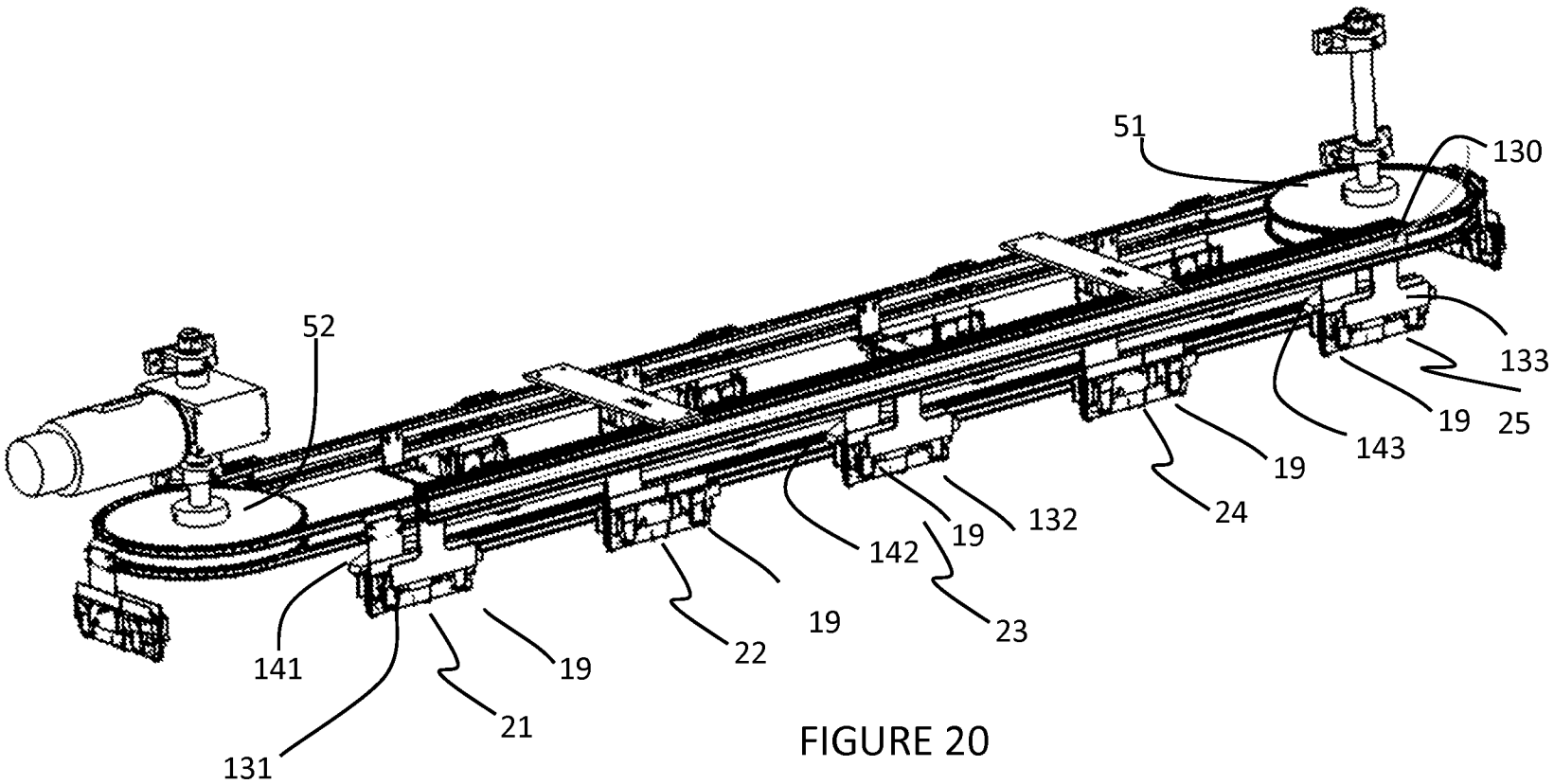

Pushing on a tab 65 opens clip 55. Pushing on a tab 66 opens clip 56. Pushing on a tab 67 opens clip 57. Pushing on a tab 68 opens clip 58. Actuator tabs at station 21, station 23 and station 25 push on the tabs 65, 66, 67 and 68 of the bag holder 19 at the respective station to simplify each operator fitting one of bags 18 over bag holder 19 and under open clips 55, 56, 57 and 58. This is illustrated in FIG. 19 and FIG. 20 where an actuator structure 31 is shown. In preparation for operators 12, 13 and 14 placing bags 18 on bag holders 19, actuator structure 31 is used to open clips 55, 56, 57 and 58 at stations 21, 23 and 25. At station 21, actuator tab 131 is compressed against tabs 65 and 66 to open clips 55 and 56 while actuator tab 141 is compressed against tabs 67 and 68 to open clips 57 and 58. At station 22, actuator tab 132 is compressed against tabs 65 and 66 to open clips 55 and 56 while actuator tab 142 is compressed against tabs 67 and 68 to open clips 57 and 58. At station 23, actuator tab 133 is compressed against tabs 65 and 66 to open clips 55 and 56 while actuator tab 143 is compressed against tabs 67 and 68 to open clips 57 and 58.

As illustrated by FIG. 8, at all stations but stations 31, 30 and 29, springs, such as spring-loaded hinges 90, hold bag holder 19 in a flat position. At stations 31, 30 and 29 an actuator 70 (shown in FIG. 10) pushes on an area 71 adjacent to clip 57 to move bag holder 19 into an open position as shown in FIG. 9. As shown in FIG. 8 and FIG. 9, a connecting piece 69 is used to attach bag holder 19 to roller chain 53 and roller chain 54. In addition to strong clips 55, 56, 57 and 58, lighter duty clips 156 are used to hold bag 18 to bag holder 19 when an operator places bag 18 onto bag holder 19 and strong clips 55, 56, 57 and 58 are not yet engaged. Clips 55, 56, 57 and 58 when engaged hold bag 18 firmly to bag holder 19 even during filling of bag 18 and until slips are disengaged using a pinch roller.

Figure 10:
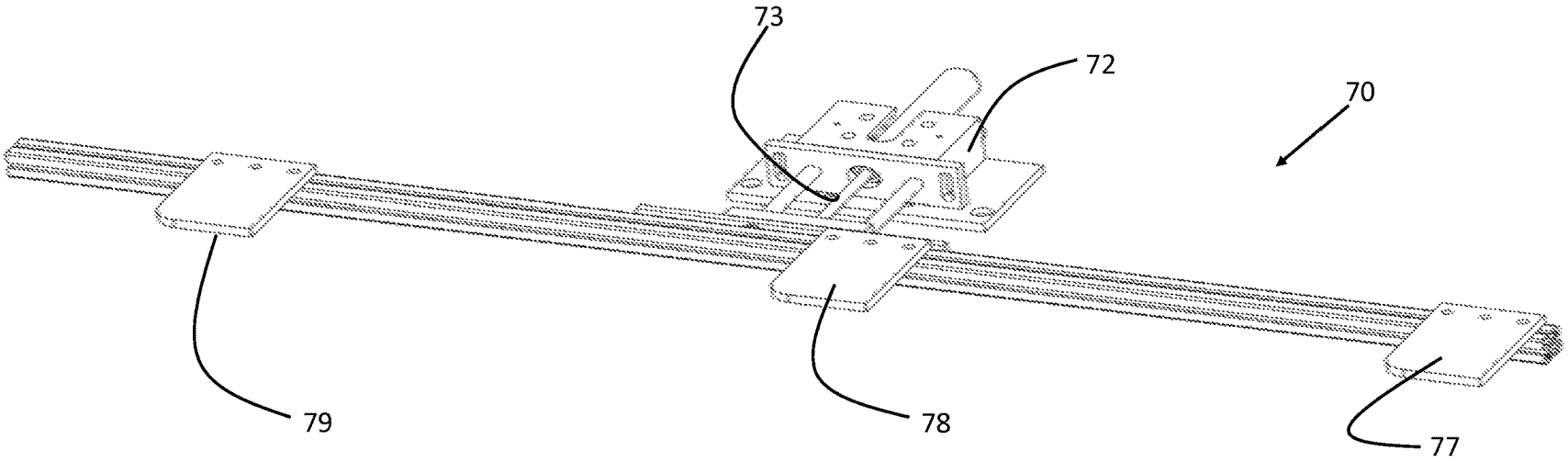
FIG. 10 and FIG. 11 illustrate how bags are opened in preparation for filling in a bag-filling machine in accordance with an implementation.
Figure 11:
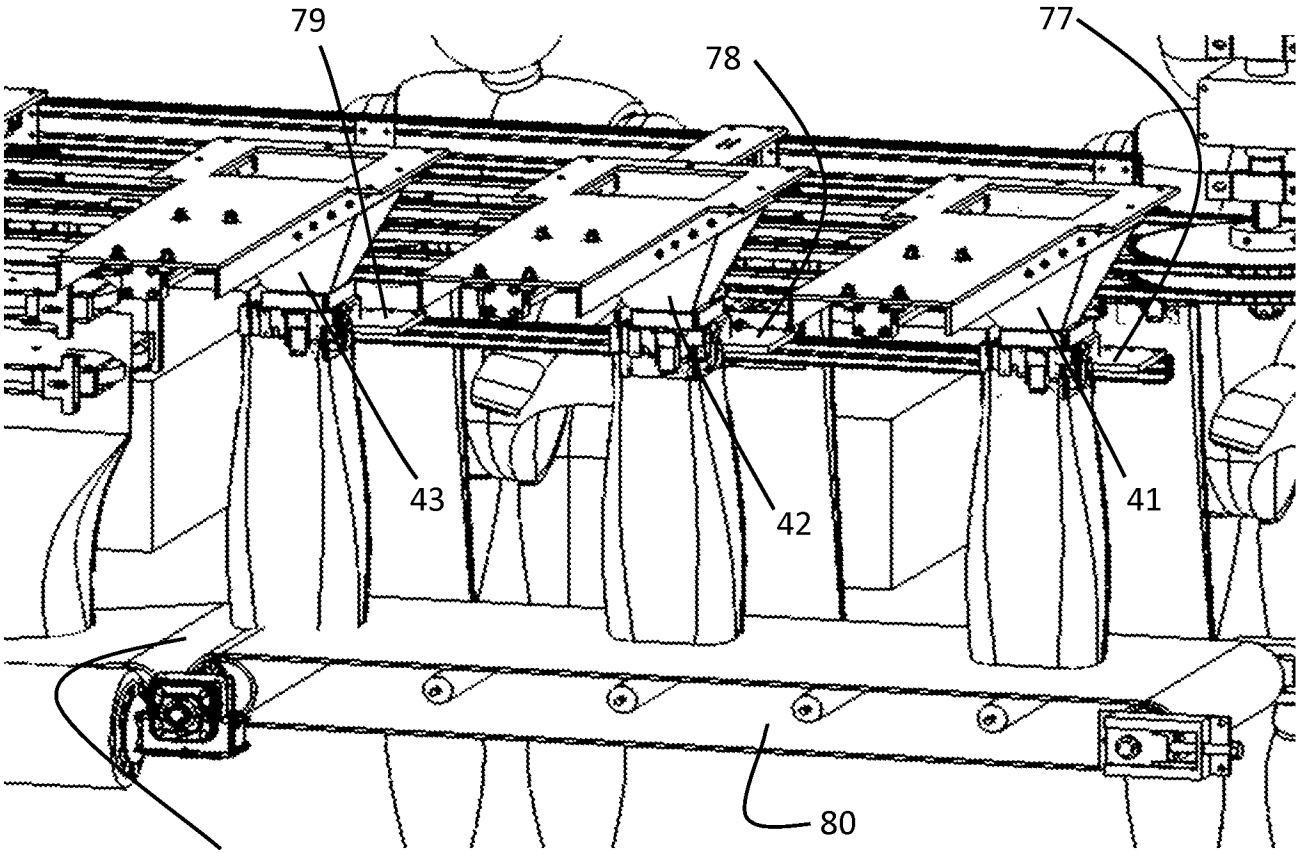

FIG. 10 and FIG. 11 show actuator 70 used to move bag holder 19 into the open position. Actuator 70 is attached to the rest of bag filing machine 1 at a base 72. An extender bar 73 moves actuator 70 into and out of an engaged position. In the engaged position, extender tab 77 at station 27 pushes on area 71 adjacent to clip 57 (shown in FIG. 9) to move bag holder 19 into an open position. In the engaged position, extender tab 78 at station 28 pushes on area 71 adjacent to clip 57 to move bag holder 19 into an open position. In the engaged position, extender tab 79 at station 29 pushes on area 71 adjacent to clip 57 to move bag holder 19 into an open position.

Figure 12:
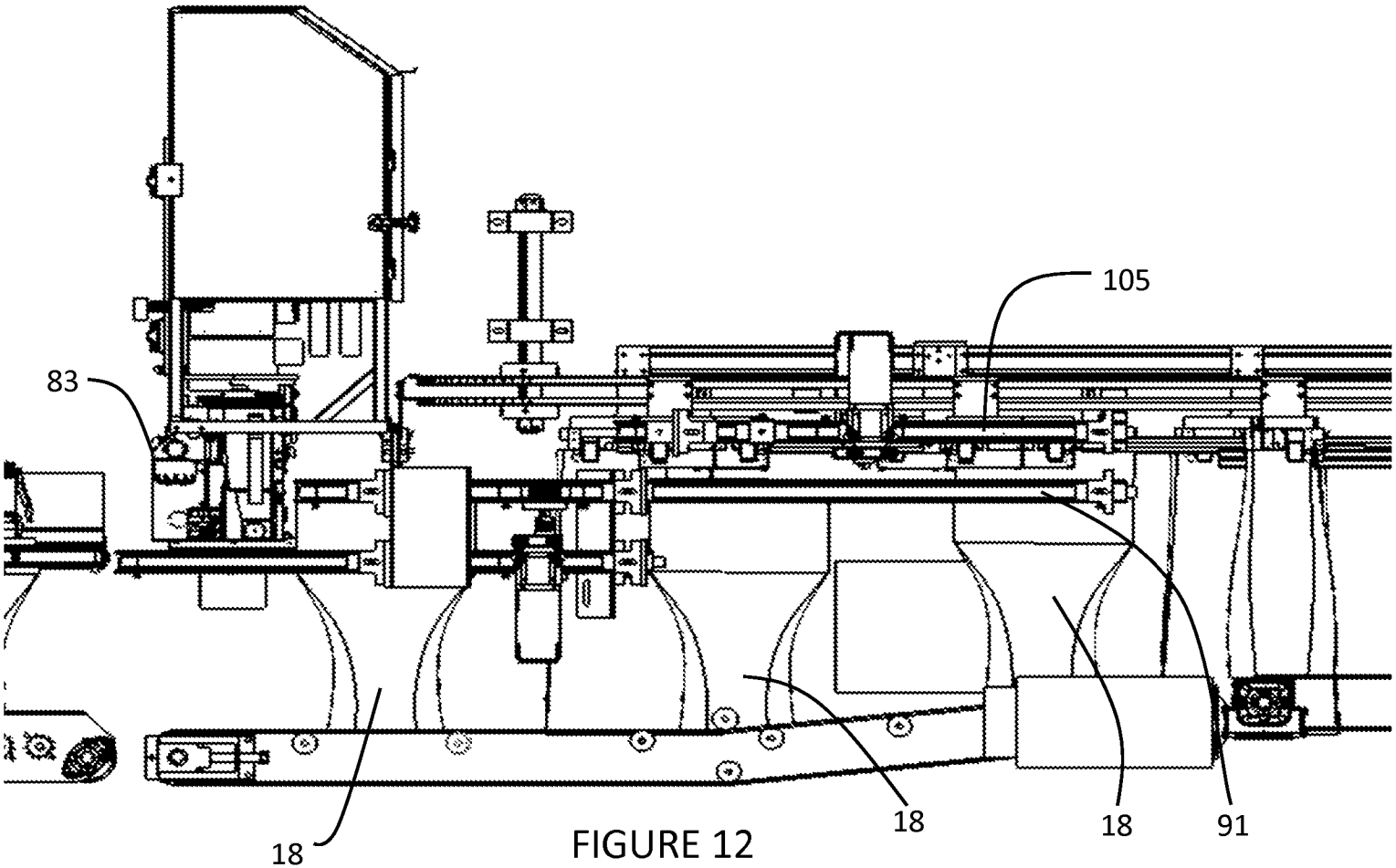
FIG. 12 and FIG. 13 illustrate transportation of bags through a sewing system in accordance with an implementation.
Figure 13:
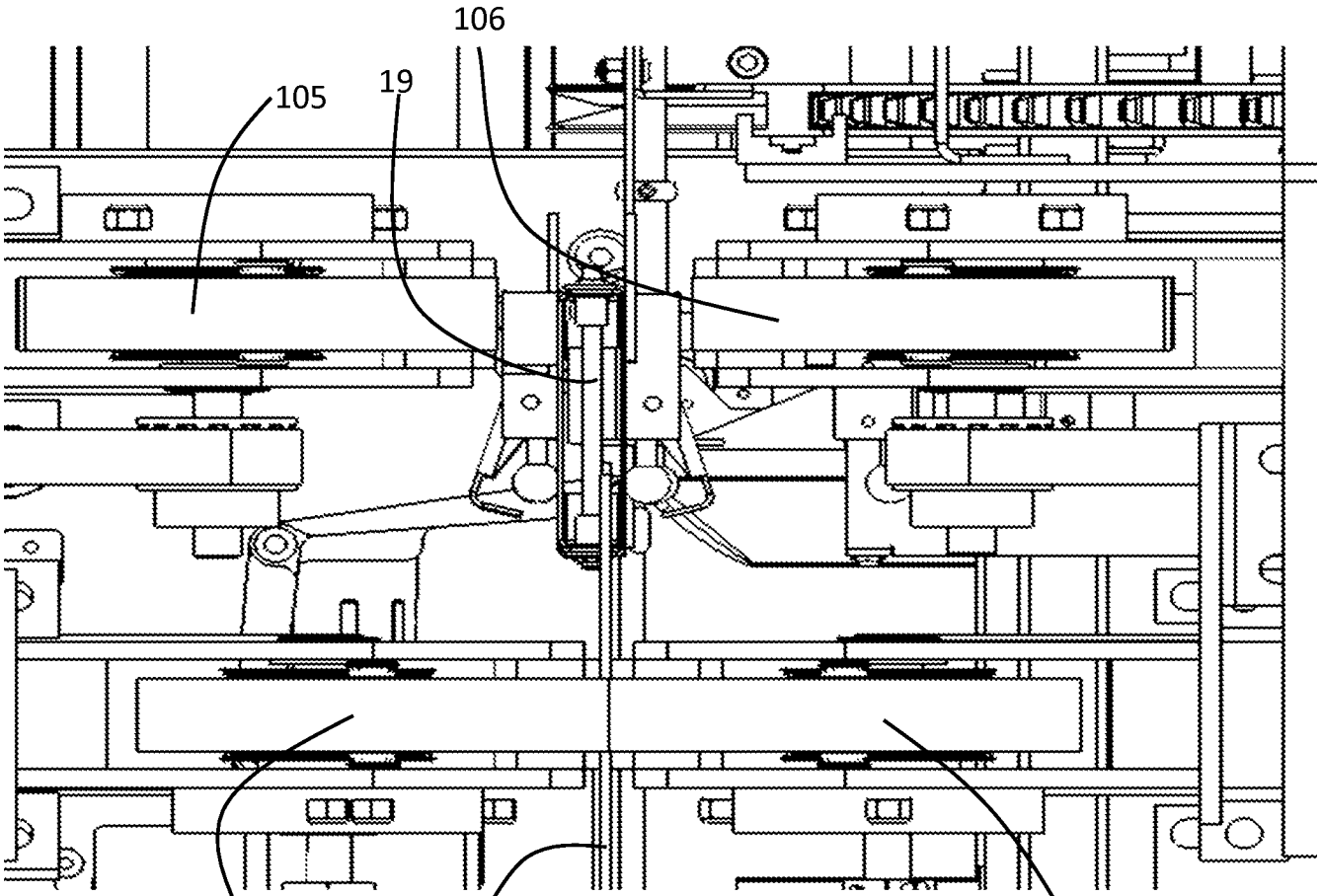

FIG. 12 and FIG. 13 illustrate bags 18 being transported by conveyer 81 to a sewing system 83 that sews bags 18 closed. As illustrated by FIG. 12 and FIG. 13, as bags 18 proceed down conveyer 81 bag holders 19 and the top region of bags 18 enter pinch rollers. Pinch roller 91 and pinch roller 92 are used to grasp the tops of bags 18. As shown by FIG. 13, separate pinch rollers 105 and 106 are used to press down tabs 65, 66, 67 and 68 to open bag clips 55, 56, 57 and 58 and release bags 18 from bag holders 19 allowing bags 18 to follow conveyer 81 down. The pinch rollers 91 and 92 keep bags 18 in an upright position as well as pinch the tops of bags 18 shut in preparation for bags 18 being sewn shut by a sewing system 83.

For example, in one implementation, as a bag 18 approaches the pinch rollers, the pinch rollers clamp bag 18 and bag holder 19 in three places: at bag holder 19, the top flap of bag 18 just under bag opener 19, and the base of bag 18 under the sewing system 83.

The top pinch clamp conveyors pinch the top of the bag holder closed while opening the strong clips 55, 56, 57 and 58 in a continuous motion to release the top of the bags. As a bag 18 is released from a bag holder 19, the top flaps of bag 18 are held by the flap pinch roller assembly As soon as bag 18 reaches the sewing level, the pinch roller assembly pinches the lower assembly guiding it through the sewing system 83.

Sensors on the pinch roller assembly signal when a bag is entering the sewing system directing the sewing system 83 to start up. Sewing system 83 does not run unless a bag 18 is present. A sensor detects when a bag is leaving sewing system 83 telling sewing system 83 when to cut the thread on bag 18.

A sensor in sewing system 83 detects when thread breaks on sewing system 83 to alert an operator that there are bags 18 that are not sewn shut.

To allow continuous duty operation, the sewing system 83 is designed such that a spare machine can be moved into place in the event of a broken needle, the thread runs out or breaks, the sewing system 83 runs out of material, or in the event of some other unforeseen sewing system failure.

Figure 14:
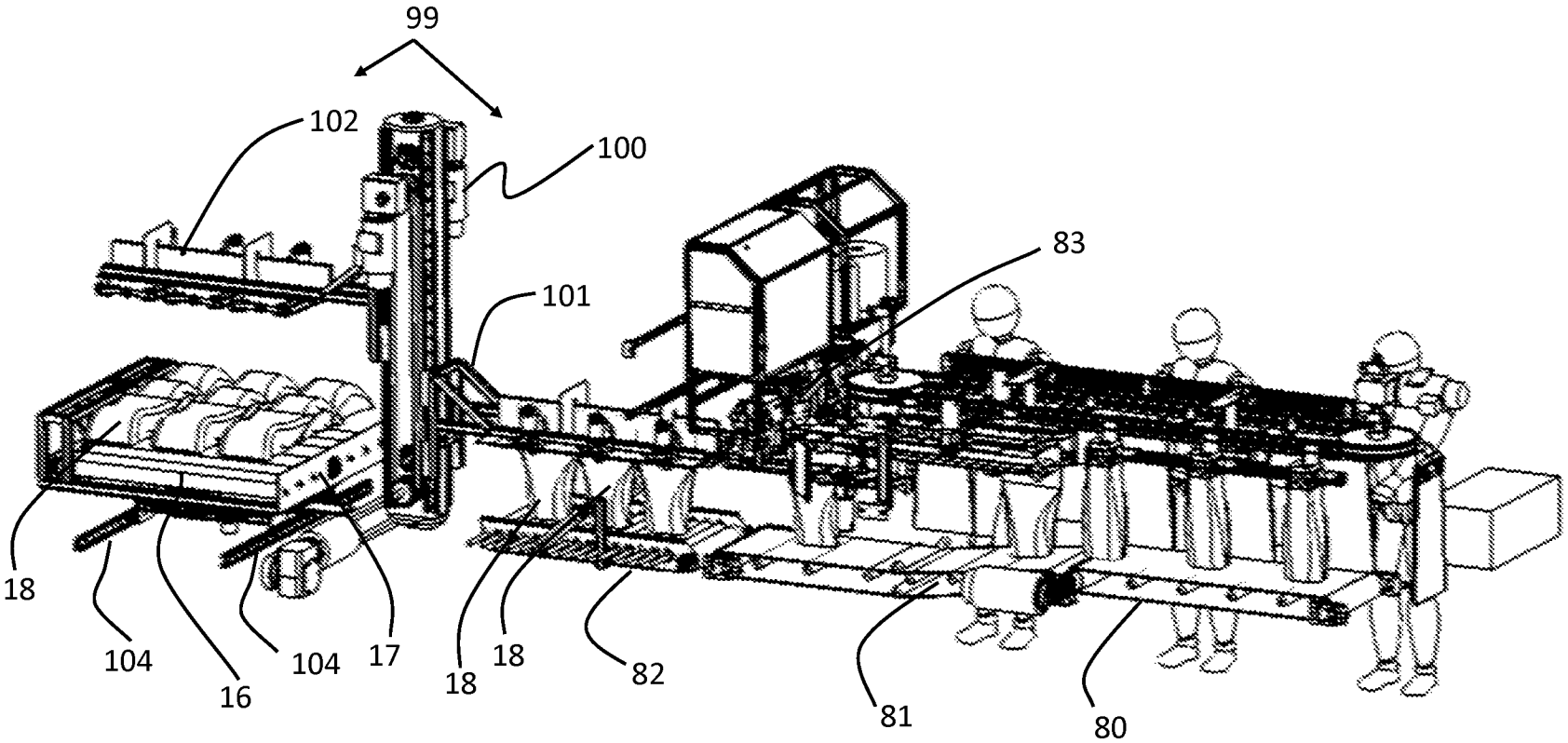
FIG. 14 illustrates stacking filled bags from a bag-filling machine in accordance with an implementation.

As shown by FIG. 14, after being sewn shut, bags 18 are conveyed to a palletizer system 99 that includes a palletizer feed conveyer 82 and a palletizer arm 101. Another palletizer arm 102 is also connected to a palletizer vertical post 100. Once palletizer arm 101 has been filled with a predetermined number of bags 18, bags 18 are elevated and palletizer arm 101 and 102 are each rotated 180 degrees around palletizer vertical post 100. Palletizer arm 102 then lowers bags 18 and stacks them on pallet 16. Palletizer actuator conveyer 17 moves along tracks 104 to stack each set of three bags 18 in a desired orientation. Palletizer actuator conveyer 17 also can rotate 90 degrees in order to allow each level of bags 18 to be in a perpendicular orientation to a previously laid layer of bags 18. This allows for versatile and efficient stacking of bags 18. When pallet 16 is full of bags 18, pallet 16 is removed from palletizer actuator conveyer 17 and a new pallet 16 is placed in position to receive more bags 18.

For example palletizer system 99 requires bag 18 to exit sewing system 83 and enter the offload conveyor system with the conveyor in the flat position. As bag 18 exits the sewing system pinch roller assembly, and while bag 18 is supported by the offload conveyor system, bag 18 transitions into a palletizer arm assembly within palletizer arm 101. Palletizer arm assembly can consist of a single pinch roller assembly or three independently controlled pinch roller assemblies.

For example, the top of bag 18 is driven through the pinch roller assembly arm with three independently controlled pinch roller assemblies. Pressure is kept on a top flap of bag 18 with independently compliant springs loaded backers. As bag 18 enters and travels through palletizer arm 101, sensors detect the location of bag 18 and stop the independently controlled pinch roller assemblies as needed as bags 18 enter palletizer arm 101. This sets the appropriate spacing of bags 18 in palletizer arm 101 to be loaded onto pallet 16 and allows compensation to be made for different widths of pallets, bags, and the spacing of bags 18.

Once palletizer arm 101 is filled with bags 18, the clamps in palletizer arm 101 engage bags 18 with sufficient force to allow bags 18 to be lifted to the height of pallet 16. Palletizer arm 101 is then rotated 180 degrees positioning the filled bags over pallet 16 on a moving actuator system.

When palletizer arm 101 is rotated, palletizer arm 102 on the opposite side of palletizer vertical post 100 is positioned to receive a next group of bags 18 from sewing system 83 and the process repeats.

For example, palletizer actuator conveyer 17 consists of a 'y' axis linear motion and a 90 rotational motion that positions and holds several common sizes of shipping pallets. The pallets are loaded and unloaded onto palletizer actuator conveyer 17 via load and unload conveyors are positioned at the extreme range of palletizer actuator conveyer 17's range. For example, the pallet load and unload conveyors consist of three independently controlled sections to allow the conveyors to be filled with three pallets on each side to provide a loading and unloading buffer to maintain throughput.

For example, the conveyors are also designed to fold up into the trailer that supports bag-filling machine 1 so the conveyors can be setup quickly and are actuated with a hydraulic cylinders to both aid in loading the belts and for holding the belts up during shipping. The amount of stroke of palletizer actuator conveyer 17 is determined such that any location on a common shipping pallet can be positioned under bags 18 on palletizer arm 101 while being held over pallet 16.

For example, three bags are placed on the edge of a pallet. Palletizer actuator conveyer 17 positions pallet 16 under the hanging bags from palletizer arm 101. Palletizer arm 101 then lowers bags 18 on pallet 16 held by palletizer actuator conveyer 17.

Area sensors determine where the bottom of bag 18 is relative to the top of pallet 16 or bags 18 already present on pallet 16. At the appropriate position, palletizer actuator conveyer 17 moves pallet 16 as palletizer arm 101 continues to lower bags 18 onto pallet 16 which directs the flap of bag 18 in the direction desired. At the appropriate height above pallet 16, palletizer arm 101 releases bags 18. Palletizer actuator conveyer 17 then continues to move pallet 16 to the next position while bags 18 are released from palletizer arm 101. The empty palletizer arm 101 then raises to the top position in preparation to rotate to a position to transport more bags 18 to pallet 16.

The process can then be repeated with bag 18 being placed in various layer techniques. For example all bags 18 can be layered in a single orientation, or bags 18 can be layered in different orientations with palletizer actuator conveyer 17 rotated 90 degrees if desired to aide in achieving a desired layer configuration.

Once pallet 16 is filled, palletizer actuator conveyer 17 moves pallet 16 to the extreme offload assembly and palletizer actuator conveyer 17 drives the loaded pallet off onto an offload conveyor. Palletizer actuator conveyer 17 then moves to the loading position where a new pallet is driven from an unload conveyor onto palletizer actuator conveyer 17.

In the meantime a load of new bags may be waiting, positioned over palletizer actuator conveyer 17 and can be positioned on the new pallet as soon as the new pallet is locked into position.

If palletizer 99 needs to be bypassed for some reason, the offload conveyor can be raised to allow bags 18 to be dropped onto an exhaust conveyor. This is achieved, for example, by raising palletizer arm 101 into an appropriate position to provide clearance for an offload conveyor to raise into the up position. The offload conveyor is raised. Filled bags exit sewing system 83, travel up the offload conveyor, fall onto an exhaust conveyor, then exit the machine onto a pallet, or loader, or other device.

For example, safety interlocked doors are used around palletizer arm 101 that extend on rails.

Alternative to entering a palletizer, bags 18 exit bag-filling machine 1 directly to a waiting truck, to a loader, to the ground, to a conveyor to some other receiving location or device. For example, the two trailers can be backed into each other at the job site.

While FIG. 1 and FIG. 14 illustrate the bagging unit (including hopper 11, roller chain 53, chute dumps 41, 42 and 43, and sewing system 43) and the palletizer (including palletizer arm 101 and palletizer vertical post 100) on a single trailer 15, the bagging unit and the palletizer can be separated and delivered to a site on two separate trailers.

Figure 15:
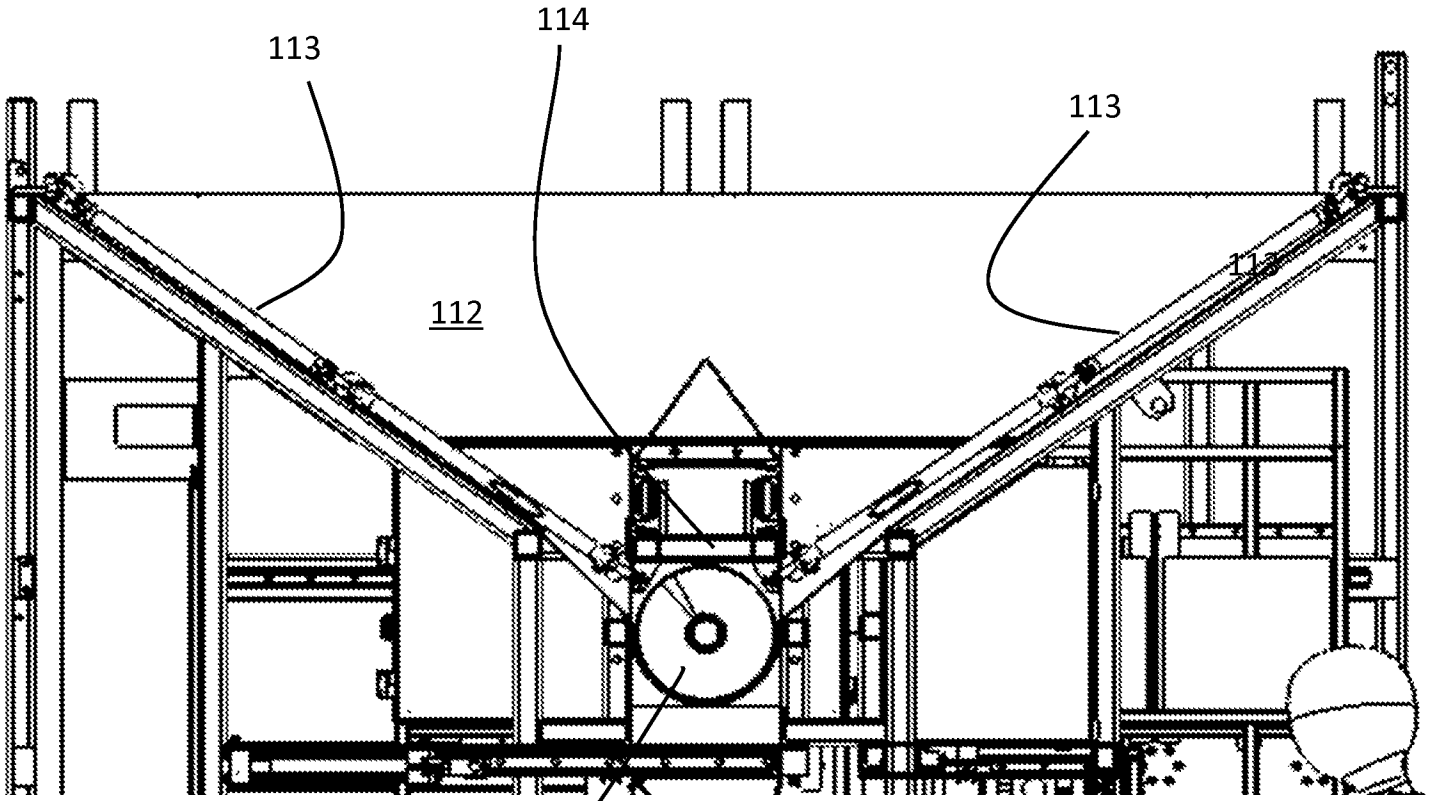
FIG. 15, FIG. 16 and FIG. 17 illustrate guidance of fill material into within a feeding unit for a bag-filling machine in accordance with an implementation.
Figure 16:
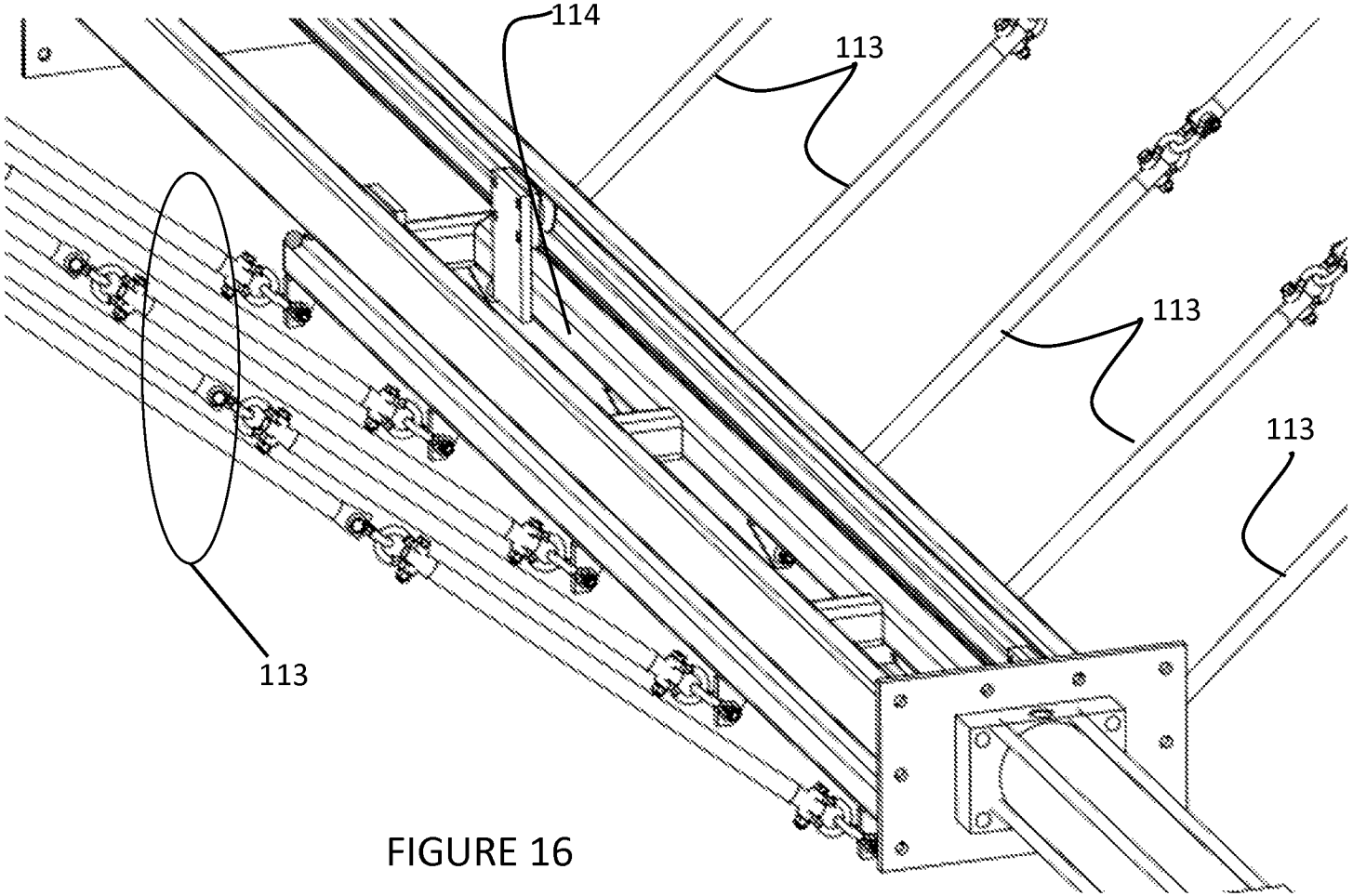
Figure 17:
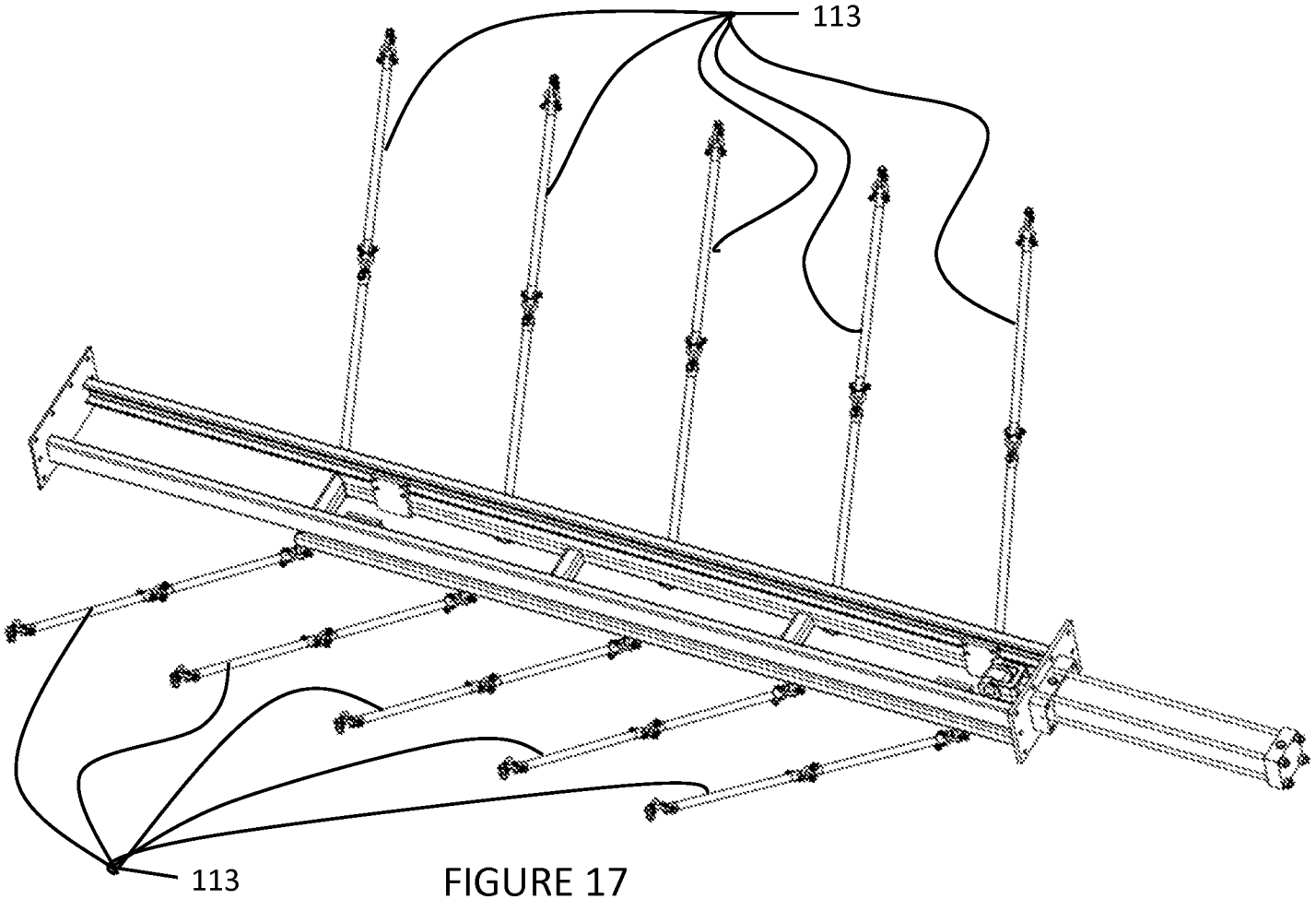

FIG. 15, FIG. 16 and FIG. 17 illustrate a stirrer assembly used to place material into position to be fed to chute dumps 41, 42 and 43. Stirrer rods 113 located within hopper 11 move sideways along slanted walls of hopper 11. This motion loosens fill material and allows it to fall into auger 11 which through rotation moves the fill material into position to be fed to chute dumps 41, 42 and 43. As illustrated by FIG. 17, stirrer rods 113 are connected to a stirrer structure 114 that is moved back and forth by a rod 115 to achieve the stirring motion of stirrer rods 113. Instead of an auger, another type of conveyer system can be used to bring fill material into position to be fed to chute dumps 41, 42 and 43.

FIG. 1 and FIG. 15 show an embodiment where hopper 11 is above chute dumps 41, 42 and 43, hopper 11 can be off to one side and use another transport mechanism to (such as a conveyer belt) to transfer fill material to chute dumps.

Figure 18:
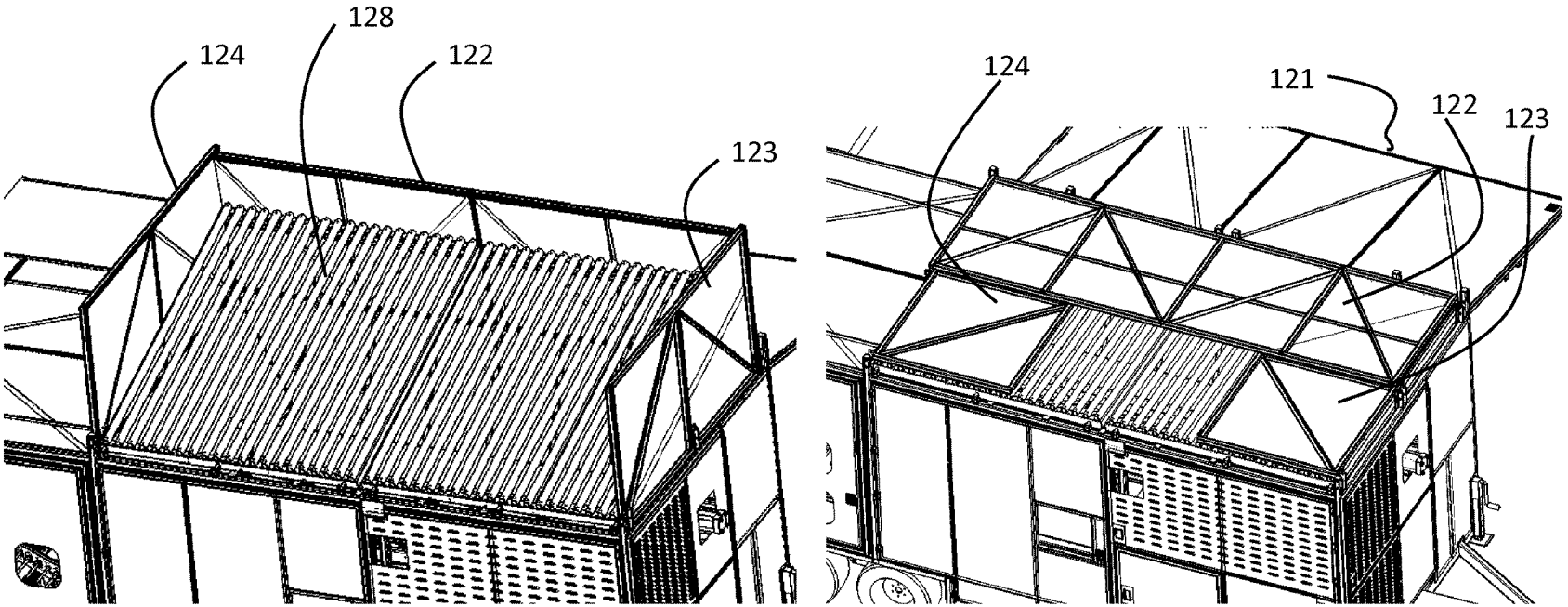
FIG. 18 shows housing for a bag-filling machine in accordance with an implementation.

FIG. 18 shows housing for bag-filling machine 1. When operating folding sections 121, 122, 123 and 124 are folded into position to catch and wayward fill material that is being loaded into hopper 11 through a screen 125 by loading fill material. The positions folding sections 121, 122, 123 and 124 prevents splashing fill material from reaching operators 12, 13 and 14 and otherwise splashing into areas around bag-filling machine 1 as new fill material is being loaded into hopper 11. Screen 125 prevents pieces of fill material large enough to cause trouble from entering hopper 11. For example screen 125 is made of common pipe that is bolted into place. Folding sections 122, 123 and 124 form walls around screen 15 and thus increase capacity of hopper 11 without significantly increasing height and weight of bag-filling machine 1 and without affecting the critical internal angles inside hopper 11 that are needed to maintain fill material flow inside hopper 11.

While FIG. 18 shows one configuration for housing, the bagging unit (including hopper 11, roller chain 53, chute dumps 41, 42 and 43, and sewing system 43) and/or the palletizer (including palletizer arm 101 and palletizer vertical post 100) can be configured in various ways depending upon application.

For example, the bagging unit and/or the palletizer can be housed in one or more shipping containers with removable sides or fold up sides. For example a single 40 foot shipping container might be used in a military or emergency response use application.

Alternatively, as described above, the bagging unit and/or the palletizer can be housed on separate trailers. This might be useful to keep weight of each trailer under 10,000 for units for applications serving an erosion control contractor or a rental user, for applications applicable configured for bag resale, service, and potential machine sales.

Alternatively, the bagging unit may be used housed and used alone with no palletizer.

For example, the bagging unit can be used in a stand alone trailer with no palletizer. This might be useful for applications such as erosion control, flood fighting and machine sales. For example, the bagging unit can be housed in a stand alone container or on a fixed mount (skid) for quarry use or military application.

For example, two bagging units can be housed with a single palletizer in a doubled or a mirrored configuration for super high volume use of the same hopper assembly. For example, this can be a useful configuration for flood fighting.

For example, the bagging unit can be fitted with a loading system that automatically loads bags onto the hooks.

Figure 21:
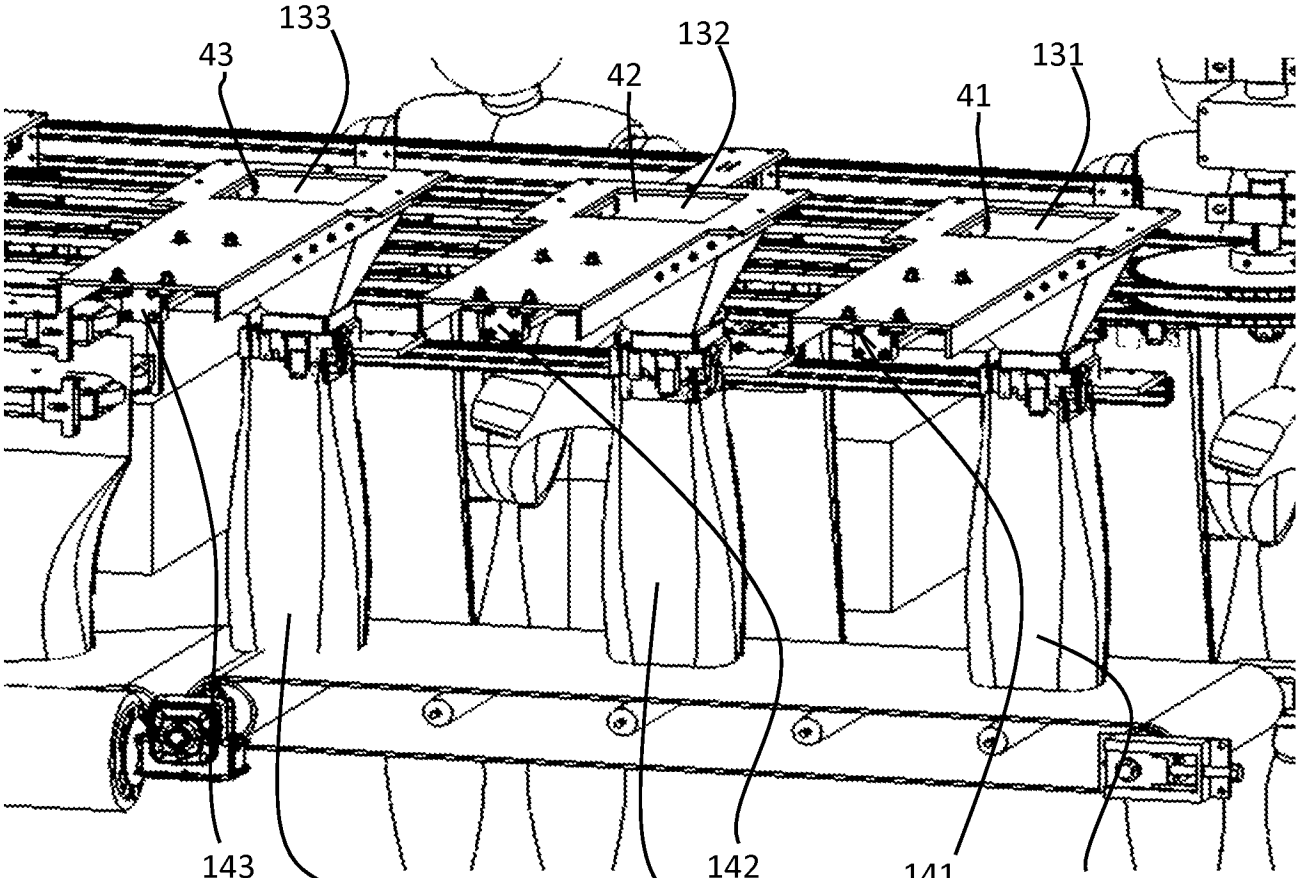
FIG. 21 shows actuators used to allow fill material to flow from dump chute in accordance with an implementation.

As illustrated in FIG. 21, an actuator is used to allow fill material to flow from a dump chute to a bag 18. For example, at station 27, an actuator 141 opens chute dump 41 allowing fill material to fill a bag 18. A sensor 151 confirms chute dump 41 is filled with fill material before actuator 141 opens chute dump 41. At station 28, an actuator 142 opens chute dump 42 allowing fill material to fill a bag 18. A sensor 152 confirms chute dump 42 is filled with fill material before actuator 142 opens chute dump 43. At station 29, an actuator 143 opens chute dump 43 allowing fill material to fill a bag 18. A sensor 153 confirms chute dump 43 is filled with fill material before actuator 143 opens chute dump 43.

After bags 18 are filled with fill material, the actuators retract allowing bags 18 to be closed by the effect of the springs within bag holders 19 springing bag holders 19 flat. This places bags 18 in position to be sewn closed and palletized.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A bag-filling machine comprising:

a hopper in which is stored fill material;

a plurality of bag holders mounted on a transport mechanism;

at least one operator station at which an operator attaches a bag to a bag holder of the plurality of bag holders;

at least one fill station where the fill material from the hopper is used to fill the bag attached to the bag holder of the plurality of bag holders; and a conveyor mechanism that conveys the bag, after it has been filled, away from the transport mechanism;

wherein the transport mechanism transports the bag holder with the attached bag from the at least one operator station to the at least one fill station;

wherein the transport mechanism transports the bag holder from the at least one fill station to the at least one operator station;

wherein each bag holder of the plurality of bag holders comprises:

a plurality of sides connected together by a plurality of hinges, a plurality of clips, each of the plurality of clips being attached to one side of the plurality of sides, wherein the plurality of sides are in a flat configuration and the plurality of clips are disengaged when the operator attaches the bag to the bag holder of the plurality of bag holders, wherein the plurality of sides are in an open configuration and the plurality of clips are engaged when the fill material from the hopper is used to fill the bag attached to the bag holder of the plurality of bag holders, and wherein the plurality of sides are in a flat configuration and the plurality of clips are disengaged when the bag is conveyed away from the transport mechanism; and wherein each clip of the plurality of clips includes a tab that is depressed to disengage the clip and is released to engage the clip; and wherein the plurality of sides comprise more than two sides and the plurality of hinges comprise more than two hinges.

2. A bag-filling machine as in claim 1 wherein each bag holder of the plurality of bag holders additionally comprises:

additional clips that the operator uses to hold the bag to the bag holder before the plurality of clips are engaged.

3. A bag-filling machine as in claim 1 wherein the conveyor mechanism comprises:

a conveyor on which filled bags rest;

pinch rollers that open the plurality of clips; and pinch rollers that hold the filled bags shut.

4. A bag-filling machine as in claim 1 wherein the transport mechanism includes two roller chains on which are mounted the plurality of bag holders, the two roller chains being mounted on two sprocket wheels.

5. A bag-filling machine as in claim 1 wherein the plurality of hinges are a plurality of spring hinges that hold the plurality of sides in the flat configuration when the bag holder travels from the at least one operator station to the at least one fill station;

wherein at each fill station, an actuator opens the bag holder by placing the plurality of sides in the open configuration so that the bag attached to the bag holder is opened in preparation for being filled with the fill material.

6. A bag-filling machine as in claim 1:

wherein the at least one fill station comprises three fill stations;

wherein the at least one operator station comprises three operator stations; and wherein there is at least one station between each of the three operator stations, so that each operator is not at an operator station immediately next to another operator station.

7. A bag-filling machine as in claim 6:

wherein the transport mechanism moves each bag holder forward three stations and then pauses to allow operators at the three operator stations to each attach a bag to a bag holder, and to allow bags at the three fill stations to be filled with the fill material.

8. A bag-filling machine as in claim 1 wherein each fill station of the at least one fill station comprises:

a dump chute; and an actuator that opens the dump chute to allow the fill material to flow from the dump chute to a bag held by a bag holder at the fill station.

9. A bag-filling machine as in claim 8 wherein a sensor within the dump chute detects whether the dump chute has a full load of the fill material ready to flow into the bag held by the bag holder at the fill station, and if there is not a full load of the fill material ready to flow into the bag held by the bag holder at the fill station, the actuator does not open the dump chute.

10. A bag-filling machine as in claim 8 wherein a sensor detects whether there exists a bag held by the bag holder at the fill station, and if there is no bag held by the bag holder at the fill station, the actuator does not open the dump chute.

11. A bag-filling machine as in claim 1, additionally comprising:

a sewing system that sews filled bags shut;

wherein the conveyor mechanism conveys each filled bag, from the transport mechanism to the sewing system.

12. A bag-filling machine as in claim 11, additionally comprising:

a palletizer system that loads the filled bags onto a pallet.

13. A bag-filling machine as in claim 12, wherein the palletizer system comprises:

a palletizer feed conveyor that receives the filled bags from the sewing system;

a palletizer arm that transports the filled bags from the palletizer feed conveyor to the pallet; and a palletizer actuator conveyor that moves the pallet to facilitate stacking of the filled bags in a desired configuration.

14. A bag-filling machine as in claim 1, wherein the hopper includes:

an auger that moves the fill material towards the at least one fill station.

15. A bag-filling machine as in claim 1, wherein the hopper includes:

stirrer rods located along inner sides of the hopper to aid with movement of the fill material in the hopper towards the at least one fill station.

16. A bag-filling machine as in claim 1, wherein the at least one operator station is located at a first side of the bag-filling machine and the at least one fill station is located at a second side of the bag-filling machine, wherein the first side is opposite to the second side.

17. A bag-filling machine as in claim 1, additionally comprising:

a sewing system that sews filled bags shut;

wherein the conveyor mechanism conveys each filled bag, from the transport mechanism to the sewing system; and a pinch roller assembly that guides the filled bags through the sewing system.

18. A bag-filling machine as in claim 17, wherein the pinch roller assembly includes pinch rollers used to disengage the plurality of clips before the filled bags enter the sewing system.

19. A bag holder for a bag-filling machine, the bag holder comprising:

a plurality of sides connected together by a plurality of hinges; and a plurality of clips, each of the plurality of clips being attached to one side of the plurality of sides;

wherein the plurality of sides are in a flat configuration and the plurality of clips are disengaged when an operator attaches a bag to the bag holder;

wherein the plurality of sides are in an open configuration and the plurality of clips are engaged when fill material from a hopper is used to fill the bag attached to the bag holder;

wherein the plurality of sides are in a flat configuration and the plurality of clips are disengaged when the bag is conveyed away from a transport mechanism;

wherein each clip of the plurality of clips includes a tab that is depressed to disengage the clip and is released to engage the clip; and wherein the plurality of sides comprise more than two sides and the plurality of hinges comprise more than two hinges.

20. A bag holder as in claim 19, wherein the plurality of sides comprises four sides and the plurality of clips comprises four clips.

* * * * *